US008274439B2

(12) United States Patent
Miller et al.

(10) Patent No.: US 8,274,439 B2
(45) Date of Patent: Sep. 25, 2012

(54) HIGH POWER, LOW PROFILE, BROADBAND ANTENNA

(75) Inventors: Gary E. Miller, Auburn, WA (US); William O. Price, Kent, WA (US)

(73) Assignee: The Boeing Company, Chicago, IL (US)

( * ) Notice: Subject to any disclaimer, the term of this patent is extended or adjusted under 35 U.S.C. 154(b) by 458 days.

(21) Appl. No.: 12/569,470

(22) Filed: Sep. 29, 2009

(65) Prior Publication Data

US 2011/0074642 A1 Mar. 31, 2011

(51) Int. Cl.
*H01Q 1/02* (2006.01)

(52) U.S. Cl. ..... 343/705

(58) Field of Classification Search ..... 343/705, 343/767, 784, 770, 746, 771
See application file for complete search history.

(56) References Cited

U.S. PATENT DOCUMENTS

| | | | | |
|---|---|---|---|---|
| 2,573,460 | A | 10/1951 | Lindenblad | |
| 4,245,222 | A | 1/1981 | Eng et al. | |
| 5,489,913 | A | 2/1996 | Raguenet et al. | |
| 6,188,368 | B1 * | 2/2001 | Koriyama et al. | 343/767 |
| 6,462,714 | B1 * | 10/2002 | Okabe et al. | 343/767 |
| 6,480,162 | B2 * | 11/2002 | Sabet et al. | 343/767 |
| 6,664,931 | B1 * | 12/2003 | Nguyen et al. | 343/767 |
| 7,129,902 | B2 * | 10/2006 | Bancroft | 343/767 |
| 7,518,564 | B2 * | 4/2009 | Guthrie | 343/767 |
| 7,804,458 | B2 * | 9/2010 | Montgomery et al. | 343/767 |

FOREIGN PATENT DOCUMENTS

EP 1181742 B1 12/2007

OTHER PUBLICATIONS

Hashemi-Yeganeh, Shahrokh, et al., "Theoretical and Experimental Studies of Cavity-Backed Slot antenna Excited by a Narrow Strip", IEEE Transactions on Antennas and Propagation, vol. 41, No. 2, Feb. 1993, pp. 236-241.

European Patent Office, Extended European Search Report for Application No. 101082285.6-2220, dated Dec. 3, 2010.

Mailloux, R.J. "Phased Array Antenna Handbook." Chapter 5—Elements, Transmission Lines, and Feed Architecture for Phased Arrays, pp. 237-322, Artech House 1994.

Newman, E.H. et al. "Some Important Parameters in the Design of T-Bar Fed Slot Antennas." IEEE Xplore, Apr. 12, 1974, pp. 97-100.

* cited by examiner

*Primary Examiner* — Huedung Mancuso
(74) *Attorney, Agent, or Firm* — Charles L. Moore; Moore & Van Allen PLLC

(57) ABSTRACT

An antenna may include an enclosure formed by a front wall and a back wall opposite to the front wall, and a front face and a back face opposite to the front face. Both the front face and the back face extend between the front wall and the back wall to form a cavity within the enclosure. The enclosure further includes a slot formed in the front face to form a cavity backed slot. A radio frequency (RF) connector is mounted in the front wall. A shaped feed line is mounted within the cavity and is electrically connected to the RF connector to transmit and receive RF energy. The shaped feed line extends across the slot to couple the RF energy between the slot and the shaped feed line. The shaped feed line has a predetermined structure to substantially reduce an electric field strength to improve power handing of the antenna.

19 Claims, 7 Drawing Sheets

HIGH POWER, LOW PROFILE, BROADBAND ANTENNA

This invention was made with Government support under contract number F19628-01-D-0016 awarded by the United States Air Force. The Government has certain rights in this invention.

FIELD

The present disclosure relates to antennas, and more particularly to a high power, low profile broadband antenna for aerospace applications.

BACKGROUND

Cavity-backed slot antennas are well suited for applications on aerospace vehicles and other vehicles. Such antennas can be recessed in the vehicle structure and create virtually no drag or effect to air flow over the vehicles surface. However, the maximum power handling capability of any antenna, at a given density altitude is determined by the maximum electric field strength that exists within the antenna. The maximum electric field strength of a cavity backed slot antenna is determined by the dimensions of the feed network geometry. Existing cavity-backed antenna elements typically use an air strip line feed to excite the slot radiator. The strip line has a very non-uniform current over the cross-section of the center conductor and the electric field between the center conductor and the outer conductor peaks significantly at the edges of the strip line center conductor (the field strength at the edge of the center conductor is typically 2-3 times higher than the field strength at the center of the center conductor. The electric current that flows on the strip line center conductor is crowded to the edges of the center conductor and the result is significant ohmic loss and heating under high power conditions. The transition from the coaxial feed to the strip line also typically results in enhanced electric field strengths in the transition region owing to the geometrical limitations of using the strip line.

BRIEF SUMMARY

In accordance with one embodiment, an antenna may include an enclosure formed by a front wall and a back wall opposite to the front wall, and a front face and a back face opposite to the front face. Both the front face and the back face extend between the front wall and the back wall to form a cavity within the enclosure. The enclosure further includes a slot formed in the front face to form a cavity backed slot. A radio frequency (RF) connector is mounted in the front wall. A shaped feed line is mounted within the cavity and is electrically connected to the RF connector to transmit and receive RF energy. The shaped feed line extends across the slot to couple the RF energy between the slot and the shaped feed line. The shaped feed line has a predetermined structure to substantially reduce electric field strength to improve power handing of the antenna.

In accordance with one embodiment, an antenna may include an enclosure including a front wall and a back wall opposite to the front wall, and a front face and a back face opposite to the front face. Both the front face and the back face may extend between the front wall and the back wall to form a cavity within the enclosure. The enclosure may further include a slot formed in the front face to form a cavity backed slot. A radio frequency (RF) connector may be mounted in the front wall. A shaped feed line may be mounted within the cavity and electrically coupled to the RF connector to transmit and receive RF energy. The shaped feed line may extend across the slot to couple the RF energy between the slot and the shaped feed line. The shaped feed line may include a rod shaped center conductor.

In accordance with one embodiment, an antenna may include an enclosure including a front wall and a back wall opposite to the front wall, and a front face and a back face opposite to the front face, wherein both the front face and the back face extend between the front wall and the back wall to form a cavity within the enclosure. The enclosure may further include a slot formed in the front face to form a cavity backed slot. A shaped feed line is mounted within the cavity and extends across the slot to couple RF energy between the slot and the shaped feed line. The shaped feed line may include a rod shaped center conductor disposed. A radio frequency (RF) connector may be mounted in the front wall and electrically coupled to the shaped feed line to transmit and receive the RF energy. The RF connector may include a transition section including a predefined shape to transition from a coaxial feed point to the shaped feed line.

Other aspects and features of the embodiments, as defined solely by the claims, will become apparent to those ordinarily skilled in the art upon review of the following non-limited detailed description in conjunction with the accompanying figures.

BRIEF DESCRIPTION OF THE SEVERAL VIEWS OF THE DRAWINGS

The following detailed description of embodiments refers to the accompanying drawings. Other embodiments having different structures and operations do not depart from the scope of the present disclosure.

DETAILED DESCRIPTION

The following detailed description of embodiments refers to the accompanying drawings, which illustrate specific embodiments. Other embodiments having different structures and operations do not depart from the scope of the present disclosure.

Figure 1A:
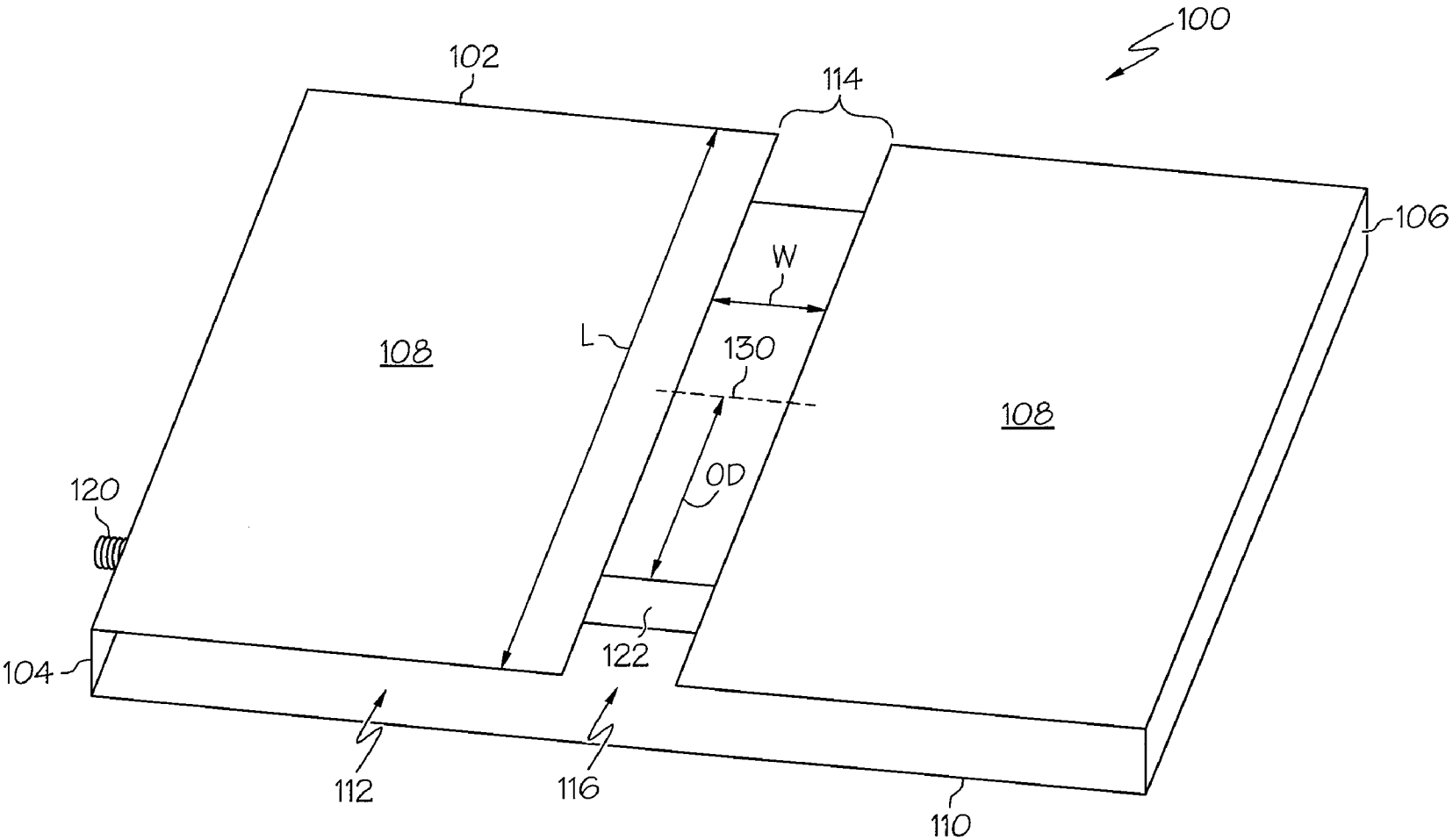
FIG. 1A is a perspective view of an example of a high power, low profile, broadband antenna in accordance with an embodiment.

FIG. 1A is a perspective view of an example of a high power, low profile, broadband antenna 100 in accordance with an embodiment. The antenna 100 includes an enclosure 102. The enclosure 102 may include a front wall 104 or input wall or side and a back wall 106 or back side opposite to the front wall 104. The enclosure 102 may also include a front face 108 and a back face 110 opposite to the front face 108. The front face 108 and the back face 110 extend between the front wall 108 and the back wall 110 to form a cavity 112 within the enclosure 102.

The enclosure 102 further includes a slot 114 formed in the front face 108 to define a cavity backed slot 116. The cavity backed slot 116 may be substantially rectangular. The dimensions of the slot 114 (width "W" and length "L") will be a function of the desired operating characteristics of the antenna 100, such as the frequency range or bandwidth of the antenna, operating power, and other operating parameters.

The enclosure 102 may be open on the sides between the front wall 104 and back wall 106 and between the front face 108 and back face 110. The enclosure 102 may define a low profile waveguide cavity with a radiating slot 114 for radiating RF energy for communications or other purposes. The enclosure 102 may be substantially rectangular in shape although other shapes, such as circular or multi-sided, may also be used depending upon the application or for other reasons. The enclosure 102 may also be non-planar depending upon the application. The size of the enclosure 102 may also be dependent on the application and operating parameters or characteristics of the antenna 100. For example, for an antenna operating between about 250 and about 350 megahertz (MHz), radiating about 20 kilowatts (kW) of peak power at about 40,000 feet altitude and at a temperature of about −20 deg Centigrade (C), the front and back walls 104 and 106 may be about 1.5 inches in height and the front face 108 and back face 110 may each have a width of about 10 inches and a length of about 20 inches. The slot 114 may have a length "L" of about 20 inches and a width "W" of about 2 inches. The walls 104, 106 of the enclosure 102 are formed from a metallic material. The front face 108 is made from a metallic material for radiating electromagnetic energy. The back face 110 is also made from a metallic material to provide the desired electromagnetic field pattern or distribution within the cavity 112.

The antenna 100 may also include a radio frequency (RF) connector 120 mounted in the front wall 104. The RF connector 120 may be adapted to connect the antenna 100 to a transceiver (not shown in FIGS. 1A and 1B) via a coaxial cable or similar electrical connection for transmitting and receiving electromagnetic energy or RF signals via the antenna 100. An example of a RF connector 300 that may be used for the RF connector 120 will be described in more detail with reference to FIG. 3 below.

Figure 1B:
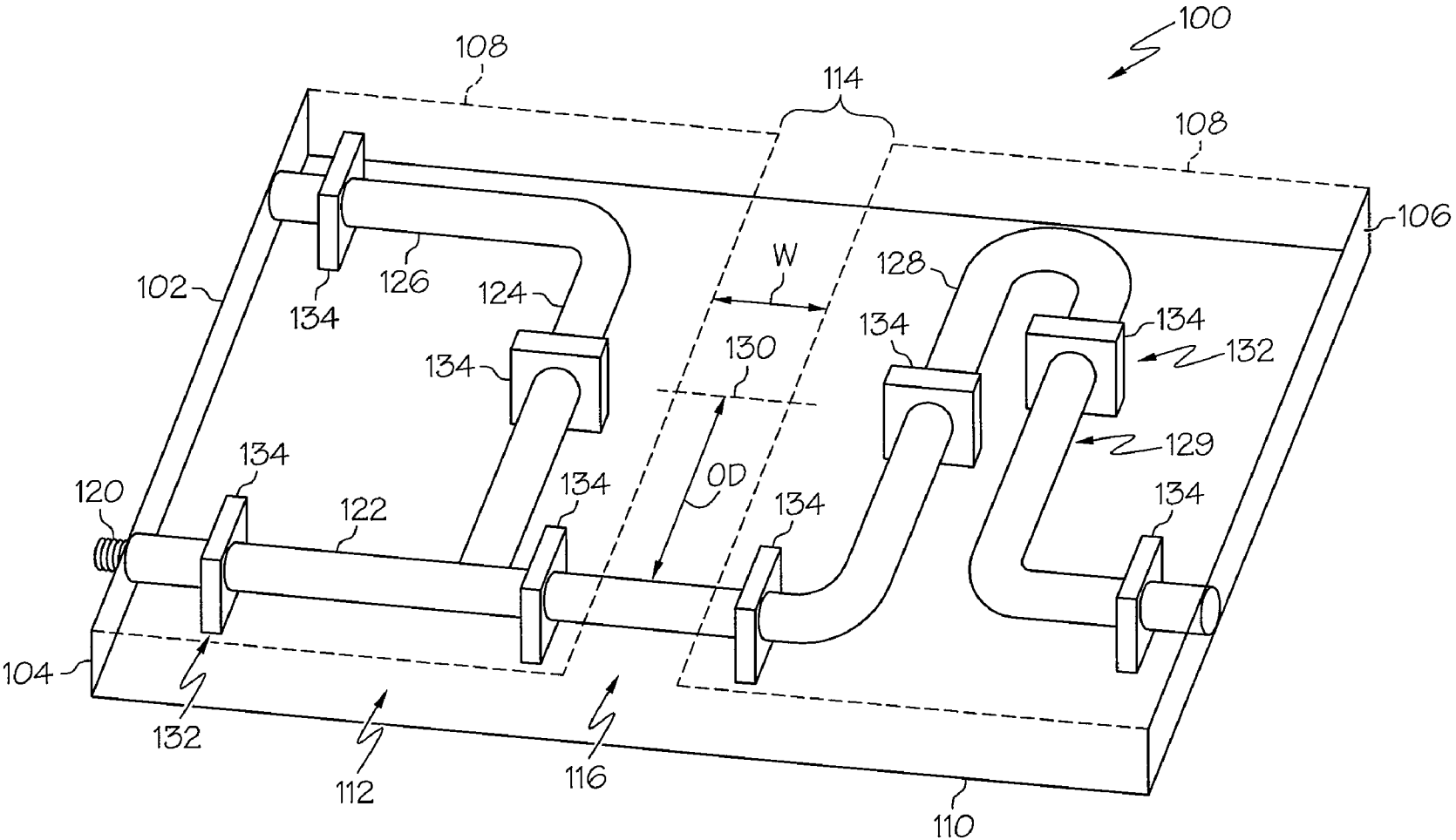
FIG. 1B is a perspective view of the high power, low profile, broadband antenna of FIG. 1A with a front face or upper face of an enclosure of the antenna removed to show an example of a shaped feed line within the cavity in accordance with an embodiment.

Referring also to FIG. 1B, FIG. 1B is a perspective view of the high power, low profile, broadband antenna 100 of FIG. 1A with the front face 108 or upper face of the enclosure 102 removed and illustrated by a broken line to show an example of a shaped feed line 122 or antenna element within the cavity 112 in accordance with an embodiment. The shaped feed line 122 is mounted within the cavity 112 and is electrically coupled to the RF connector 120 to transmit and receive RF energy or signals. The shaped feed line 122 extends across the slot 114 as best illustrated in FIG. 1A to couple the RF energy between the slot 114 and the shaped feed line 122. The shaped feed line 122 has a predetermined structure and cross-section to substantially reduce the electric field strength to improve power handing of the antenna 100, particular in aerospace vehicle applications where the vehicle flies above a predetermined altitude. An example of a shaped feed line 600 that may be used for the shaped feed line 122 will be described in more detail with reference to FIG. 6 below.

In accordance with an embodiment, a tee section 124 and a shunt tuning stub 126 may be electrically connected to the shaped feed line 122. One end of the tee section 124 is connected to the shaped feed line 122. An opposite end of the tee section 124 is electrically connected to one end of the shunt tuning stub 126. An opposite end of the shunt tuning stub 126 is electrically connected to the front wall 104 of the enclosure 102 to short circuit the shunt tuning stub 126 to the front wall 104 and the enclosure 102. The tee section 124 and the shunt tuning stub 126 include a selected length and diameter to tune the antenna to a desired impedance bandwidth. The tee section 124 and shunt tuning stub 126 may each have the same structure and cross-section as the feed line 122 or may each have a different structure and cross-section depending on the application and desired operating characteristics of the antenna 100. The tee section 124 and the shunt tuning stub 126 may be connected to the shaped feed line 122 at a location before the feed line 122 extends across the slot 114.

After the shaped feed line 122 extends across the slot 114 to couple RF energy that is radiated by the slot 114, the shaped feed line 122 may transition into a series tuning stub 128. The series tuning stub 128 may be formed in an elongated loop 129. The series tuning stub 128 is electrically connected to the back wall 106 of the enclosure 102 to short circuit the series tuning stub 128 to the back wall 106 of the enclosure 102. The series tuning stub 128 includes a selected length and diameter to tune the antenna 100 to a desired bandwidth.

If both the shunt tuning stub 126 and series tuning stub 128 are present, the stub diameters (characteristic impedances) and lengths may be selected or selectively tuned in combination to optimize the impedance bandwidth to the antenna 100 as described herein.

Figure 2:
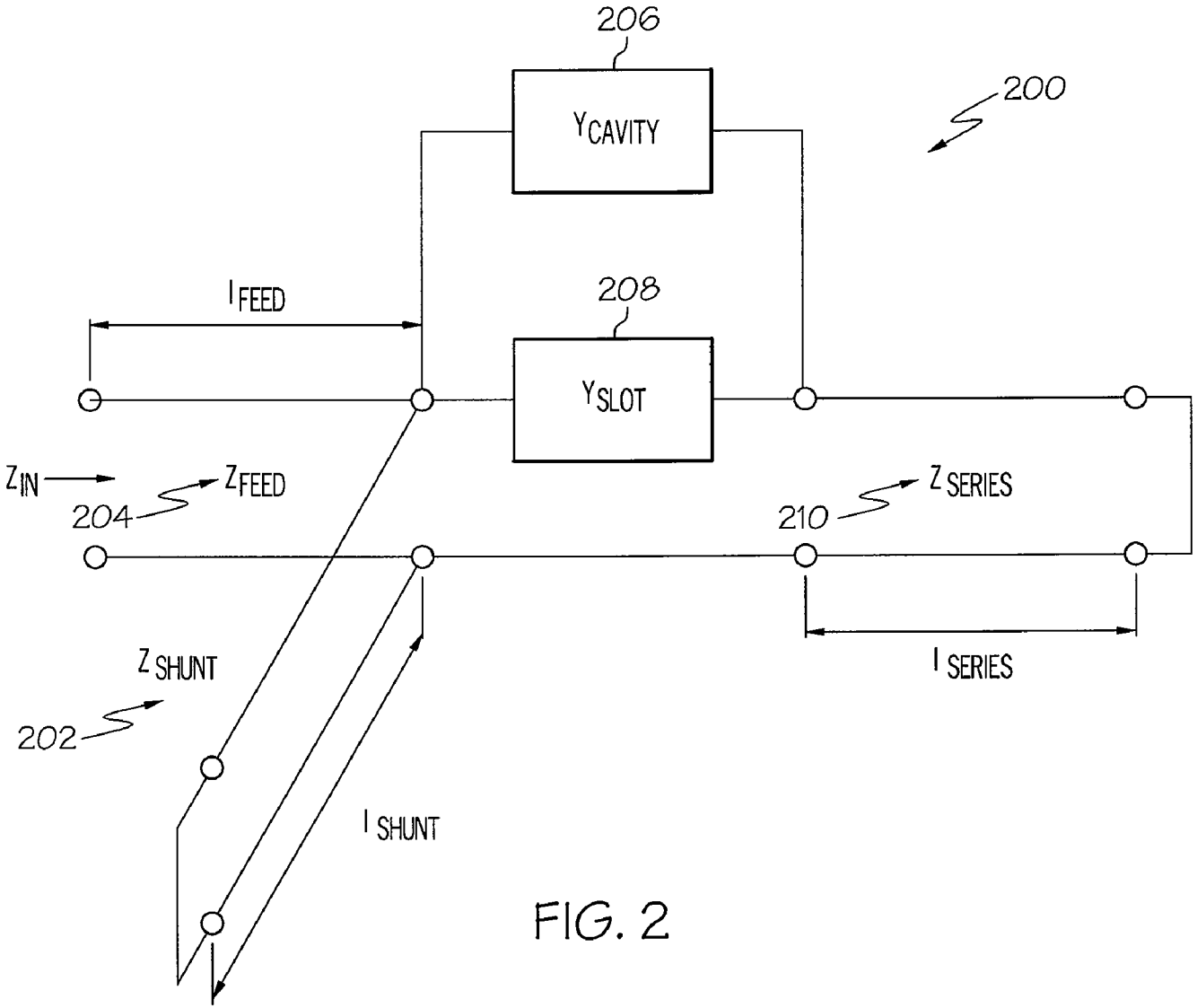
FIG. 2 is a schematic diagram of an equivalent circuit of the example of the shaped feed line in FIG. 1B.

FIG. 2 is a schematic diagram of an equivalent circuit 200 of the example of the feed line 122 in FIG. 1B. Impedance of the shunt tuning stub $Z_{shunt}$ 202 is illustrated in parallel with the impedance of the shaped feed line $Z_{feed}$ 204. Following the shunt tuning stub is the admittance of the cavity $Y_{cavity}$ 206 and admittance of the slot $Y_{slot}$ 208 in parallel with one another. After the parallel combination of the cavity and slot admittance 206 and 208 is the impedance of the series tuning stub $Z_{series}$ 210.

Referring back to FIGS. 1A and 1B, the shaped feed line 122 may be mounted within the cavity at a chosen offset distance "OD" from a midpoint 130 of the slot 114 as measured along an elongated dimension or length "L" of the slot 114. The chosen offset distance "OD" may be adjusted to provide an optimized antenna impedance bandwidth.

The antenna 100 may additionally include a support arrangement 132 mounted within the enclosure 102 to support the shaped feed line 122 within the cavity 112. The support arrangement 132 may be formed from a dielectric material and may include a form to substantially minimize any alteration of an electromagnetic field pattern or distribution within the cavity 112. In one embodiment, the support arrangement 132 may include filling the cavity 112 with a low loss, low density foam or other support material with similar properties that will not adversely affect the electromagnetic field pattern within the cavity 112. An example of a low loss, low density foam that may be used to fill the cavity 112 for the support arrangement 132 may be Eccostock available from Emerson & Cuming Microwave Products, Inc. of Randolph, Mass. Eccostock is a trademark of Emerson & Cuming Microwave Products, Inc. in the United States, other countries or both.

Another example for the support arrangement 132 that may be used to support the shaped feed line 122 and any tuning stubs 124, 126 and 128 is illustrated in FIG. 1B. This exemplary support arrangement 132 may include a plurality of dielectric supports 134 that may be mounted at preselected positions within the enclosure 102 to suitably support the shaped feed line 122 under all possible operating conditions, for example if the antenna 100 is used on an aerospace vehicle. The plurality of dielectric supports 134 may also permit drainage of moisture that may be produced by the repeated ascent and descent cycling of an aerospace vehicle.

Each of the plurality of dielectric supports 134 may be formed from a block of dielectric material, such as a hard, durable engineering plastic. A hole may be formed through each block to provide a tight fit for the feed line 122. Each block may then be cut in half with some non-planar interlocking shape to permit easy assembly of the antenna 100. An important feature is that the form or size of the supports be electrically small to substantially minimize any alteration of the electromagnetic field pattern or distribution within the antenna 100. The supports may also be shaped to maintain the power handling performance of the antenna. The supports 134 may be attached to the interior of the enclosure 102 by an adhesive, such as epoxy or the like, by a non-conductive fastener or other means.

Figure 3:
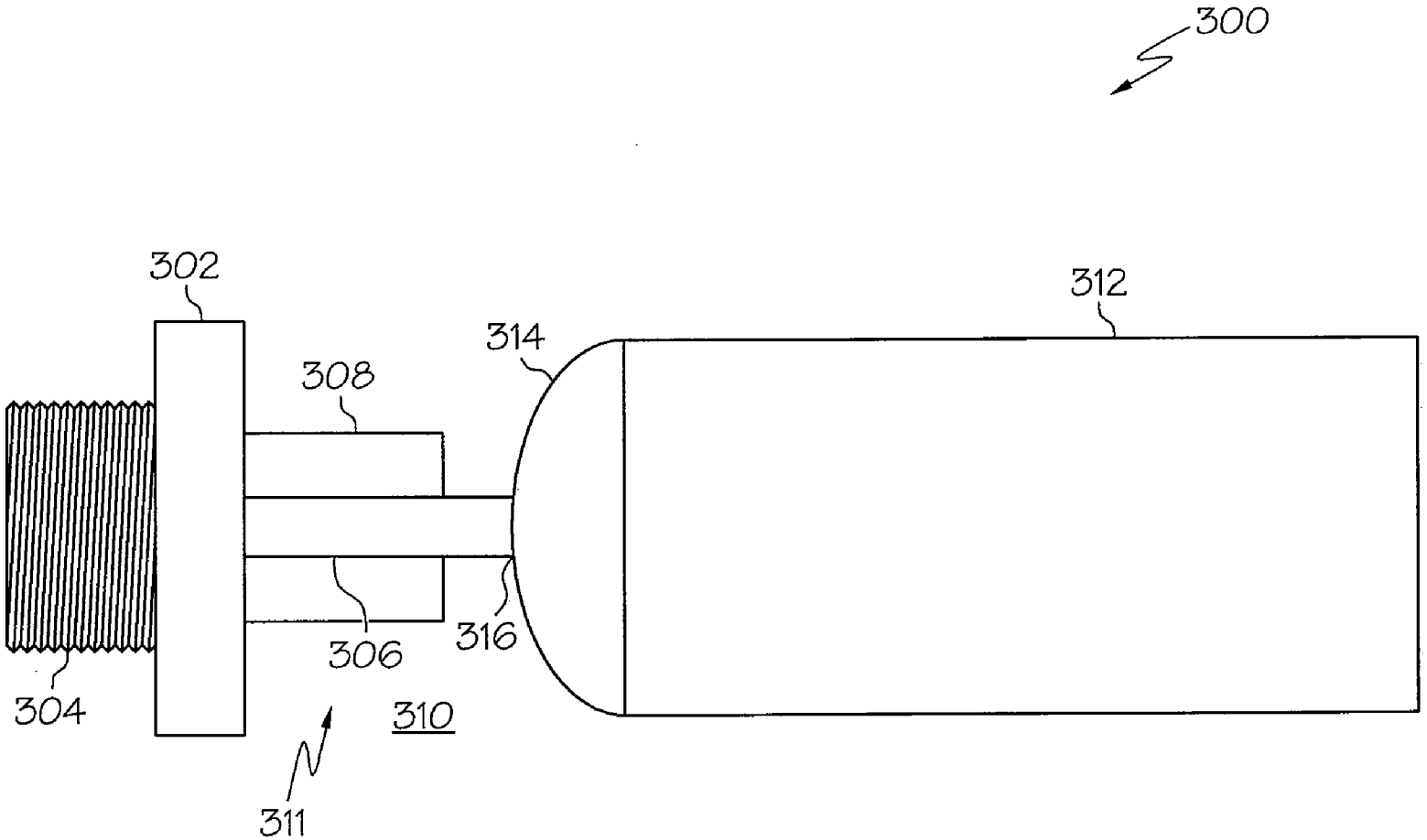
FIG. 3 is a side view of a radio frequency (RF) connector in accordance with an embodiment.

FIG. 3 is a side view of a radio frequency (RF) connector 300 in accordance with an embodiment. The RF connector 300 may be used for the RF connector 120 in FIGS. 1A and 1B. The RF connector 300 is mounted in an end wall 302 of an enclosure (not shown) similar to front wall 104 of enclosure 102 in FIGS. 1A and 1B. The RF connector 300 may include an externally threaded coaxial fitting 304 for receiving a coaxial cable connector of a coaxial cable (not shown in FIG. 3) over which RF energy or signals may be transmitted to and from the antenna, such as antenna 100. A center conductor 306 is electrically connected to a center conductor of the coaxial fitting 304 and may extend through an insulator 308 within the enclosure or cavity 310. The insulator 308 abuts the end wall 302 to substantially prevent RF breakdown in a feed region 311. The feed region 311 may be defined as an area surrounding where the RF connector 300 or coaxial center conductor 306 connects and/or transitions into a shaped feed line 312. As illustrated in FIG. 3, the small diameter coax center conductor 306, an extension of the RF connector 300 mounted to the end wall 302, connects and transitions to the much larger diameter shaped center conductor 312 of the feed line. The feed region 311 of the antenna proximate to the transition from the small diameter coax center conductor 306 to the larger diameter shaped feed line center conductor 312 may be filled with a dielectric material, such as Teflon or other similar dielectric material, to substantially prevent RF breakdown in this feed region 311 or transition region. Teflon is a trademark of E.I. Du Pont De Nemours and Company Corporation, Wilmington, Del. in the United States, other countries or both.

The RF connector 300 also includes a transition section 314. The transition section 314 may include a predefined shape to transition from a coaxial feed point 316 of the coaxial center conductor 306 to the shaped center conductor 312 of the feed line. The predefined shape of the transition section 314 may be substantially dome shaped if the shaped center conductor 312 is a circular rod as described herein as one example of a shaped center conductor of a shaped feed line. The predefined shape of the transition section 314 may also be other shapes depending upon the structure and/or cross-section of the shaped center conductor of the feed line of the antenna.

Figure 4:
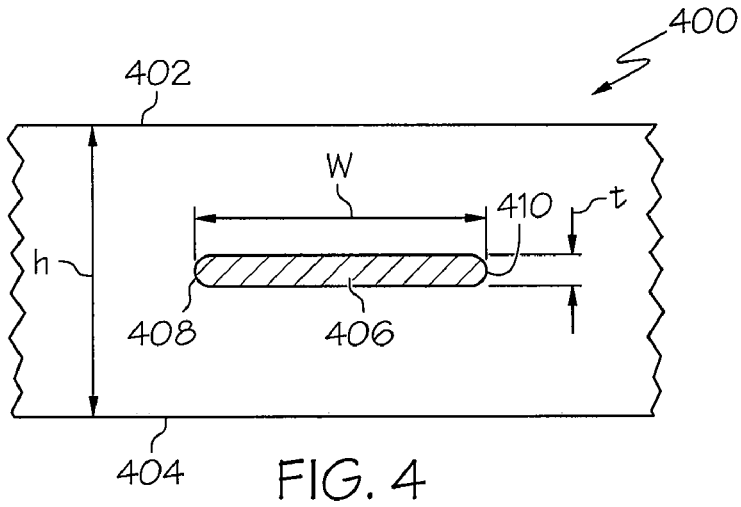
FIG. 4 is a cross-sectional view of an exemplary strip line feed.

FIG. 4 is a cross-sectional view of an exemplary strip line feed 400. The height "h" between the outer conductors 402 and 404 is about 3 inches. The outer conductors 402 and 404 may correspond to the front and back faces on an antenna enclosure, such as front and back faces 108 and 110 of enclosure 102 of FIG. 1A. The center conductor 406 has a thickness "t" of about 0.125 inches and width "w" of about 3.9 inches. These dimensions provide a strip line feed with a characteristic impedance of about 50 ohms. For this feed line structure, the ratio of the maximum electric field to the applied voltage is about 1.43/cm. Thus, for the 50 ohm strip line feed 400 and a 1 volt excitation the maximum electric field strength in the dielectric (insulator 308 in FIG. 3) would be about 1.43 v/cm. This field strength will occur at the rounded edges 408 and 410 of the center conductor 406.

Figure 5:
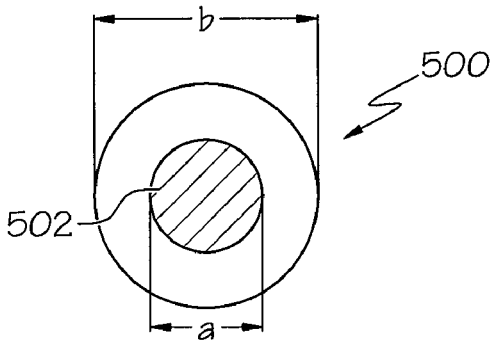
FIG. 5 is a cross-sectional view of an exemplary coaxial feed line.

For comparison purposes, referring also to FIG. 5, FIG. 5 is a cross-sectional view of an exemplary coaxial feed line 500. The diameter "b" of the coaxial feed line is about 3 inches to be complimentary with the strip line 400 of FIG. 4. The center conductor 502 has a diameter "a" of about 1.3 inches. These dimensions provide the coaxial feed line 500 with a characteristic impedance of about 50 ohms similar to the strip line feed 400. Because of the rotational symmetry of the coaxial feed line 500, the maximum electric field strength for a 1 volt excitation is about 0.724 v/cm for the 50 ohm coaxial feed line or roughly half that of the strip line 400.

Figure 6:
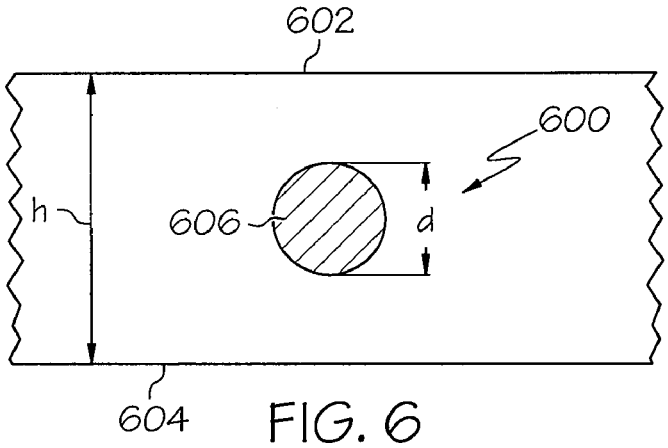
FIG. 6 is a cross-section of an example of a shaped feed line in accordance with an embodiment.

FIG. 6 is a cross-section of an example of a shaped feed line 600 in accordance with an embodiment. A pair of elongated parallel outer conductors 602 and 604 corresponds to the front face 108 and the back face 110 of enclosure 102 in FIG. 1A. The outer conductors 602 and 604 may be positioned at a selected distance "h" of 3 inches from one another to be complimentary with strip line feed 400 and coaxial feed 500. The shaped feed line 600 includes a shaped center conductor 606 disposed between the pair of outer conductors 602 and 604. The shaped center conductor 606 includes a selected shape, cross-section and size to substantially reduce the electric field strength to improve power handing performance compared to other feed lines while maintaining other desirable performance characteristics or features. The other desirable performance characteristics or features may include a selected physical size, a selected weight, and a selected RF bandwidth.

The selected shape of the center conductor 606 may be a rod. The rod may be substantially circular shaped with an appropriate diameter and length to provide a chosen characteristic impedance, for example 50 ohms. The circular rod shaped center conductor 606 with a diameter of about 1.65 inches will have a characteristic impedance of 50 ohms. A shaped center conductor with this structure will have a maximum field strength for a one volt excitation of about 0.737 v/cm or less. This is approximately half the field strength for the strip line 400 with the same height "h" of 3 inches. Because RF breakdown is determined by the maximum electric field strength, the shaped feed line 600 can be powered or excited to approximately twice the voltage (4 times the power) of the strip line 400. Because the shaped feed line 600 spreads the current over a larger portion of the cross section of the line compared to the strip line 400, the selected shape or cross-section of the center conductor 606 of the shaped feed line 600 compared to the strip line 400 substantially reduces ohmic losses to improve antenna efficiency and reduce internal temperature of the antenna. Accordingly, these characteristics of the shaped feed line 600 provide improved RF power handling capability particularly in aerospace applications and particularly at high altitudes, such as for example at flight levels above about thirty thousand feet.

While the shaped feed line 600 has been described as having a rod shaped center conductor 606 with a substantially circular cross-section, other rods with cross-sections other than circular may also be used that provide similar or better operating characteristics compared to those described above.

Figure 7:
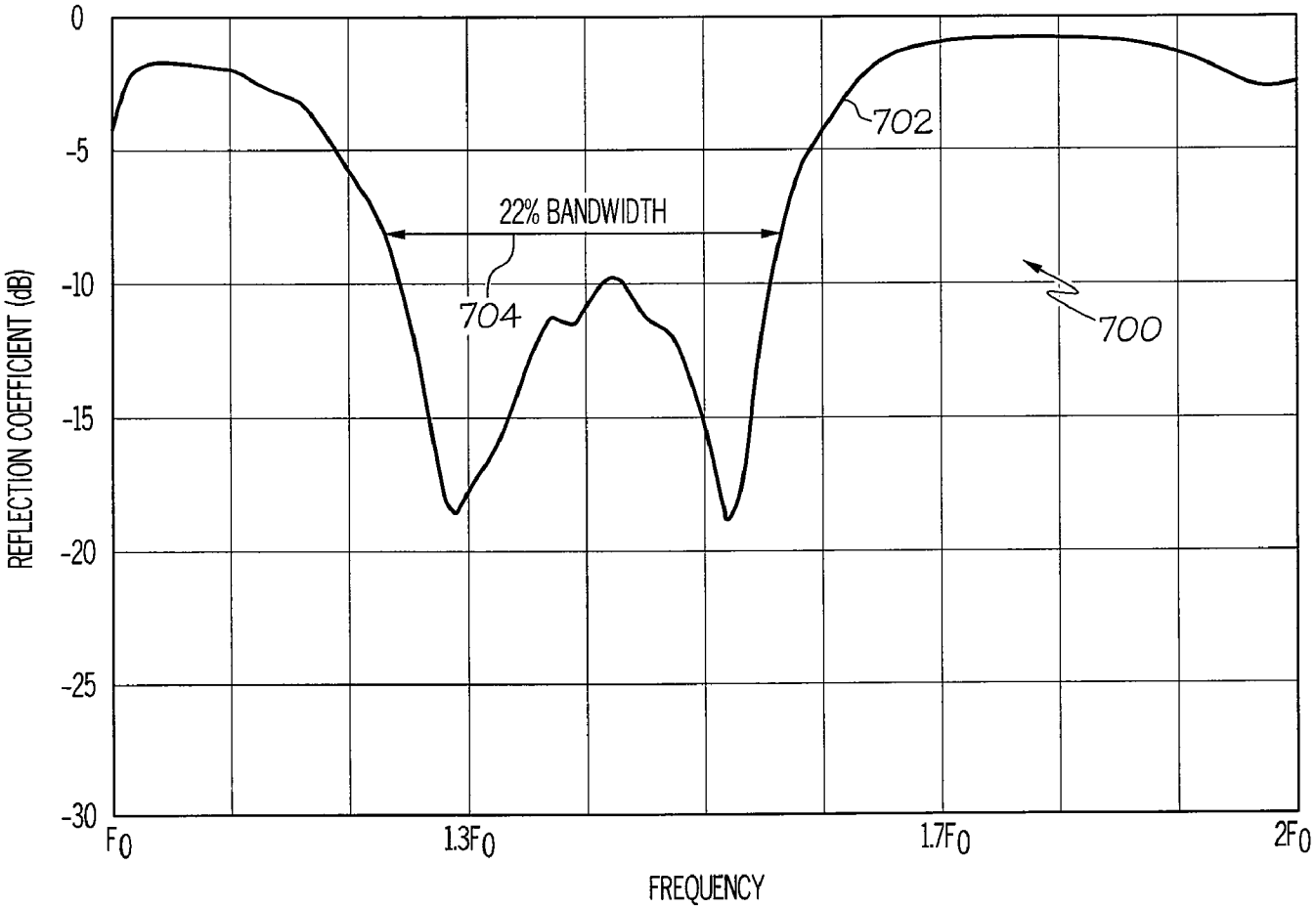
FIG. 7 is a graph showing measured reflection coefficient performance of a shaped feed line cavity backed slot antenna in accordance with an embodiment.

FIG. 7 is a graph 700 showing measured reflection coefficient performance of a shaped feed line cavity backed slot antenna in accordance with an embodiment. The graph 700 includes a waveform 702 of reflection coefficient (dB) versus frequency. The shaped feed line cavity backed slot antenna may be similar to that described herein. As show in graph 700, the shaped feed line cavity backed slot antenna as described herein may provide an impedance bandwidth 704 of at least about 22%. This compares favorably with a conventional strip line feed but with much improved power handing capabilities as described above.

Figure 8:
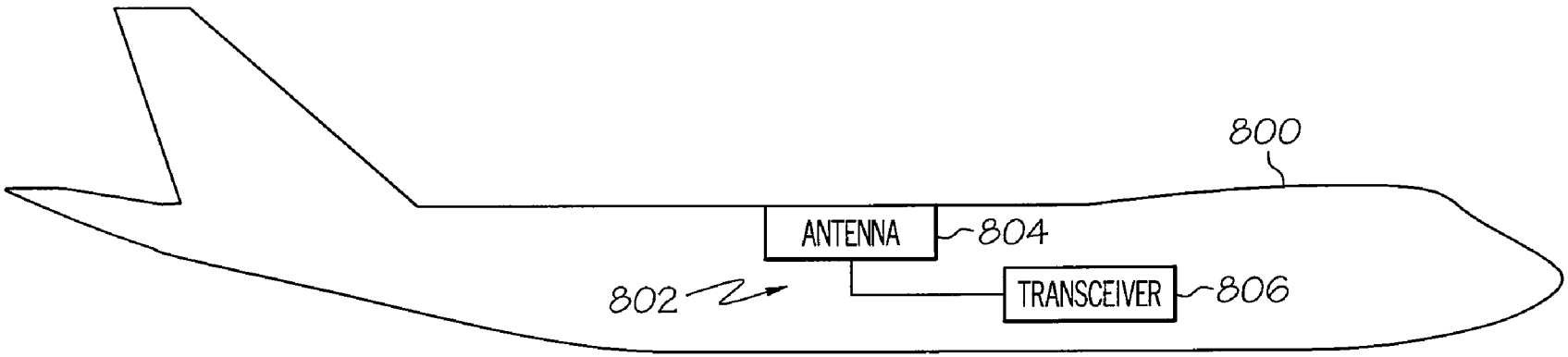
FIG. 8 is an illustration of an aerospace vehicle including a communications system and antenna in accordance with an embodiment.

FIG. 8 is an illustration of an aerospace vehicle 800 including a communications system 802 and antenna 804 in accordance with an embodiment. The aerospace vehicle 800 may be an airplane, spacecraft or other vehicle. The communications system 802 may include a transceiver 806 for sending and receiving signals via the antenna 804. The antenna 804 may be a high power, low profile, broadband antenna similar to that described herein. For example the antenna 804 may be a cavity backed slot antenna similar to that shown and described with reference to FIGS. 1A, 1B, 2, and 3, and with a shaped feed line similar to that described with reference to FIG. 6. The cavity backed slot antenna 804 has a low profile. The antenna 804 may have a height of about 1 inch and can be recessed in the surface of the aerospace vehicle 800 as illustrated in FIG. 8 so that no draft is created by the antenna 804.

Although specific embodiments have been illustrated and described herein, those of ordinary skill in the art appreciate that any arrangement which is calculated to achieve the same purpose may be substituted for the specific embodiments shown and that the embodiments may have other applications in other environments. This application is intended to cover any adaptations or variations of the embodiments. The following claims are in no way intended to limit the scope of the disclosure to the specific embodiments described herein.

What is claimed is:

1. An antenna, comprising:

an enclosure including a front wall and a back wall opposite to the front wall, and a front face and a back face opposite to the front face, wherein both the front face and the back face extend between the front wall and the back wall to form a cavity within the enclosure, and wherein the enclosure further includes a slot formed in the front face to form a cavity backed slot;

a radio frequency (RF) connector mounted in the front wall;

a shaped feed line mounted within the cavity, the shaped feed line being electrically coupled to the RF connector to transmit and receive RF energy, and wherein the shaped feed line extends across the slot to couple the RF energy between the slot and the shaped feed line, and wherein the shaped feed line has a predetermined structure to substantially reduce an electric field strength to improve power handing of the antenna;

a tee section electrically connected to the shaped feed line; and a shunt tuning stub electrically connected to the tee section and to the front wall of the enclosure to short circuit the shunt tuning stub to the front wall, wherein the tee section and the shunt tuning stub include a selected length and diameter to tune the antenna to a desired antenna bandwidth.

2. The antenna of claim 1, wherein the shaped feed line comprises a center conductor with a selected shape or cross-section compared to a strip line feed to substantially reduce the electric field strength to improve power handing performance relative to the strip line feed while maintaining a set of selected characteristics of the strip line feed, wherein the set of selected characteristics of the strip line feed comprise a selected physical size, a selected weight and a selected RF bandwidth, and wherein the selected shape or cross-section of the center conductor compared to the strip line substantially reduces ohmic losses to improve antenna efficiency and reduce an internal temperature of the antenna.

3. The antenna of claim 1, wherein the shaped feed line comprises a center conductor with a selected shape to substantially reduce ohmic losses causing heating of the antenna and reducing RF power handing capability particularly above a predetermined flight altitude in an aerospace vehicles application of the antenna.

4. The antenna of claim 1, wherein the shaped feed line comprises a center conductor disposed between the front face and the back face and extending between the front wall and the back wall, the center conductor including a selected shape or cross-section to provide a maximum field strength for a one volt excitation of about 0.737 v/cm or less.

5. The antenna of claim 4, wherein the center conductor is a rod center conductor.

6. The antenna of claim 5, wherein the rod center conductor is substantially circular shaped with an appropriate diameter and length to provide a chosen characteristic impedance.

7. The antenna of claim 1, further comprising a series tuning stub within the enclosure and connected in series with the shaped feed line and the back wall of the enclosure, wherein the series tuning stub includes a selected length and diameter to tune the antenna to a desired antenna bandwidth.

8. The antenna of claim 1, wherein the shaped feed line is mounted within the cavity at a chosen offset distance from a midpoint of the slot, wherein the chosen offset distance may be adjusted to provide an optimized antenna impedance bandwidth.

9. The antenna of claim 1, further comprising a support arrangement mounted within the enclosure to support the shaped feed line within the cavity, wherein the support arrangement is formed from a dielectric material and includes a form to substantially minimize any alteration of an electromagnetic field pattern within the cavity.

10. The antenna of claim 1, where the RF connector comprises a transition section, the transition section including a predefined shape to transition from a coaxial feed point to the shaped feed line.

11. The antenna of claim 10, wherein the predefined shape of the transition section comprises a substantially dome shape to transition from a coaxial feed point to the shaped feed line.

12. The antenna of claim 10, further comprising a dielectric material filled in a feed region of the cavity and around the transition section to substantially prevent RF breakdown in the feed region.

13. The antenna of claim 1, wherein the front face, the front wall and the back wall are formed from a non-metallic material.

14. The antenna of claim 1, wherein the antenna is mounted in an aerospace vehicle.

15. An antenna, comprising:

an enclosure including a front wall and a back wall opposite to the front wall, and a front face and a back face opposite to the front face, wherein both the front face and the back face extend between the front wall and the back wall to form a cavity within the enclosure, and wherein the enclosure further includes a slot formed in the front face to form a cavity backed slot;

a radio frequency (RF) connector mounted in the front wall;

a shaped feed line mounted within the cavity, the shaped feed line being electrically coupled to the RF connector to transmit and receive RF energy, and wherein the shaped feed line extends across the slot to couple the RF energy between the slot and the shaped feed line, and wherein the shaped feed line comprises a rod shaped center conductor; and a shunt tuning stub electrically connected to the feed line and to the front wall of the enclosure to short circuit the shunt tuning stub to the front wall.

16. The antenna of claim 15, wherein the rod shaped center conductor is substantially circular shaped with an appropriate diameter and length to provide a chosen characteristic impedance and a maximum field strength for a one volt excitation of about 0.724 v/cm or less.

17. The antenna of claim 15, further comprising:

a series tuning stub connected in series with the shaped feed line and the back wall of the enclosure, wherein each of the shunt tuning stub and the series tuning stub include a selected length and diameter to tune the antenna to a desired antenna bandwidth.

18. An antenna, comprising:

an enclosure including, a front wall and a back wall opposite to the front wall, and a front face and a back face opposite to the front face, wherein both the front face and the back face extend between the front wall and the back wall to form a cavity within the enclosure, and wherein the enclosure further includes a slot formed in the front face to form a cavity backed slot;

a shaped feed line mounted within the cavity and extending across the slot to couple RF energy between the slot and the shaped feed line, and wherein the shaped feed line comprises a rod shaped center conductor;

a radio frequency (RF) connector mounted in the front wall and electrically coupled to the shaped feed line to transmit and receive the RF energy, wherein the RF connector comprises a transition section including a predefined shape to transition from a coaxial feed point to the shaped feed line; and a shunt tuning stub electrically connected to the feed line and to the front wall of the enclosure.

19. The antenna of 18, further comprising:

a series tuning stub connected in series with the shaped feed line and the back wall of the enclosure, wherein the shunt tuning stub and the series tuning stub each include a selected length and diameter to tune the antenna to a desired antenna bandwidth.

* * * * *